US009809052B2

(12) United States Patent
Heipp

(10) Patent No.: US 9,809,052 B2
(45) Date of Patent: Nov. 7, 2017

(54) CONTAINER WITH INTEGRATED CLOSURE AND METHODS

(71) Applicant: Elmer's Products, Inc., Atlanta, GA (US)

(72) Inventor: Shawn D. Heipp, Dublin, OH (US)

(73) Assignee: Elmer's Products, Inc., Atlanta, GA (US)

( * ) Notice: Subject to any disclaimer, the term of this patent is extended or adjusted under 35 U.S.C. 154(b) by 43 days.

(21) Appl. No.: 15/098,106

(22) Filed: Apr. 13, 2016

(65) Prior Publication Data

US 2016/0297599 A1 Oct. 13, 2016

Related U.S. Application Data

(60) Provisional application No. 62/146,575, filed on Apr. 13, 2015.

(51) Int. Cl.

| | |
|---|---|
| ***B43K 7/12*** | (2006.01) |
| ***B43M 11/06*** | (2006.01) |
| ***A45D 40/06*** | (2006.01) |
| ***A45D 40/22*** | (2006.01) |
| ***A45D 40/10*** | (2006.01) |
| ***A45D 40/04*** | (2006.01) |
| ***A45D 40/02*** | (2006.01) |

(52) U.S. Cl.

CPC ..... *B43M 11/06* (2013.01); *A45D 40/023* (2013.01); *A45D 40/04* (2013.01); *A45D 40/06* (2013.01); *A45D 40/065* (2013.01); *A45D 40/10* (2013.01); *A45D 40/22* (2013.01); *A45D 40/222* (2013.01)

(58) Field of Classification Search

CPC ..... A45D 40/04; A45D 40/06; A45D 40/065; A45D 40/10; A45D 40/22; A45D 40/222; B43M 11/06

USPC ..... 401/107

See application file for complete search history.

(56) References Cited

U.S. PATENT DOCUMENTS

| | | | | |
|---|---|---|---|---|
| 5,171,096 | A * | 12/1992 | Perrotti | A45D 40/065 401/59 |
| 5,979,468 | A * | 11/1999 | Blake, III | A45D 40/06 132/317 |
| 6,102,598 | A * | 8/2000 | Hsu | A45D 40/065 401/59 |
| 8,096,721 | B2 * | 1/2012 | Carroll | A45D 40/023 401/108 |
| 2006/0029456 | A1 * | 2/2006 | Liu | A45D 40/06 401/108 |

* cited by examiner

*Primary Examiner* — Jennifer C Chiang

(74) *Attorney, Agent, or Firm* — Eversheds Sutherland (US) LLP

(57) ABSTRACT

Containers for products such as glue sticks are provided. The containers include a valve and a mechanical device for advancing a product through the container and for opening the valve. The mechanical device includes a screw component having a base portion and a threaded portion, a valve lifter component selectively slidable between a retracted position, in which the valve is closed, and alternatively an extended position, in which the valve is open, a biasing element that engages and applies force to the valve lifter component, and an elevator component for advancing the product through the container.

20 Claims, 10 Drawing Sheets

CONTAINER WITH INTEGRATED CLOSURE AND METHODS

CROSS-REFERENCE TO RELATED APPLICATIONS

This application claims priority to U.S. Provisional Application No. 62/146,575, filed Apr. 13, 2015, which is incorporated by reference herein in its entirety.

BACKGROUND

The present disclosure relates in general to a container for solid or semi-solid materials, and more specifically to a container or dispenser for use with a glue stick or the like, wherein a closure for effectively sealing the container is integrated into the container.

Glue sticks are typically solid or semi-solid adhesives that are provided in twist tubes, push-up tubes, or similar dispensers. The user of such products may dispense the adhesive by removing a cap and holding the open tube, thus keeping their fingers relatively clean. Because of their ease of use and their recognized economic value, glue sticks are a popular school and office supply item. Glue sticks are usually designed to glue paper and card materials together, and are not typically as strong as some liquid-based variants. Glue sticks may be used for craft and design, office use, and at schools or other places of education and creativity. Permanent, washable, acid-free, non-toxic, solvent free, and dyed (e.g., to assist the user in seeing where the glue is being applied) varieties of glue stick products are commercially available with the most common sizes being 8 g, 25 g, 36 g, and 40 g.

Despite the popularity and widespread use of glue sticks, the containers or dispensers provided with such products still, in almost all cases, include a removable cap that can be easily misplaced, lost, or broken. Without a properly sealing cap, the adhesive will dry out and become useless. The loss of a functional cap may also result in the dispensing of adhesive onto various surfaces where its use was not intended. Thus, there is an ongoing need for a container for use with glue sticks or other materials that provides both an effective means for dispensing the product and a properly sealing closure that cannot be easily broken or lost.

SUMMARY

In one aspect, a container is provided, including an exterior housing, a valve disposed at a first end of the exterior housing, wherein the valve includes a plurality of adjacent sections that are configured to contact one another to seal the container when the valve is in a closed position, and a mechanical device for advancing a product through the container and for opening the valve. The mechanical device includes a screw component having a base portion positioned outside of the exterior housing at a second end opposite the valve and a threaded portion extending from the base portion within the exterior housing, a valve lifter component operable to open the valve and positioned at least partially within the exterior housing, wherein the valve lifter component is selectively slidable between a retracted position, in which the valve is closed, and alternatively an extended position, in which the valve is open, a biasing element positioned at a first end of the valve lifter component, wherein the biasing element engages and applies force to the valve lifter component, and an elevator component positioned within the exterior housing for advancing the product through the container, wherein the elevator component is engaged and operated by the threaded portion of the screw component.

In another aspect, a method for dispensing a product from a container is provided, including providing a container that includes an exterior housing, a valve disposed at a first end of the exterior housing, and a mechanical device for advancing the product through the container and for opening the valve, including a screw component, a valve lifter component, an elevator component, and a biasing element. The method includes rotating a base portion of the screw component that is positioned outside of the exterior housing at a second end opposite the valve, to correspondingly rotate a threaded portion of the screw component within the exterior housing and thereby advance the elevator component, to advance the product through the container, wherein advancing the elevator component decreases a load on the biasing element, such that the biasing element applies a force effective to selectively slide the valve lifter component into an extended position in which the valve lifter component opens the valve.

BRIEF DESCRIPTION OF THE DRAWINGS

Referring now to the drawings, which are meant to be exemplary and not limiting, and wherein like elements are numbered alike. The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Certain embodiments of the present disclosure are now described with reference to the Figures. Although the following detailed description contains many specifics for purposes of illustration, a person of ordinary skill in the art will appreciate that many variations and alterations to the following details are within the scope of the disclosure. Accordingly, the following embodiments of the disclosure are set forth without any loss of generality to, and without imposing limitations upon, the appended claims.

As previously stated, the present disclosure generally relates to containers for solid or semi-solid materials, and more specifically to containers or dispensers for use with a glue stick or the like, wherein the container contains an integrated closure for sealing the container. As used herein, the term "integrated" refers to the closure being associated with the housing of the container such that the closure may be opened in normal usage without separation of the closure from the housing.

This container may be used with materials other than glue or adhesive sticks such as lip stick, lip balm, deodorant, anti-chafing balm, writing implements that include wax or similar substances, and numerous other materials that can be formed into a cylindrical shape and that are typically stored in a capped container.

With reference to FIGS. 1A-1E, certain embodiments of the present disclosure include a container 100 that includes an exterior housing 102. In certain embodiments that exterior housing is substantially cylindrical or tubular in shape. In other embodiments, the exterior housing may be elongated with a cross-section that is rectangular or another suitable shape. The container 100 also includes an integrated closure 110 disposed at one end of the exterior housing 102. In certain embodiments, the closure 110 is a valve. The terms "closure" and "valve" are therefore used interchangeably throughout this disclosure.

In certain embodiments, the valve is self-sealing. As used herein, the term "self-sealing" refers to the valve or closure having suitable flexibility and resiliency to permit the valve to open when sufficient force is applied thereto and to spontaneously close and seal the container when that force is released or removed. For example, the valve may be formed of an elastomer, such as silicone. In certain embodiments, the material or materials from which the valve is manufactured includes moisture barrier properties for preventing or significantly reducing moisture loss from a glue stick or other product within the container.

Figure 5A:
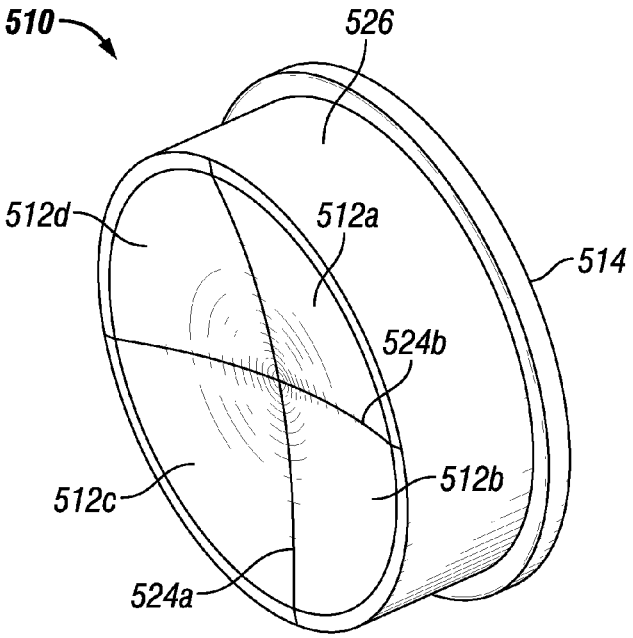
FIG. 5A is a perspective view of an integrated closure/valve, in accordance with one embodiment of the present disclosure.
Figure 5B:
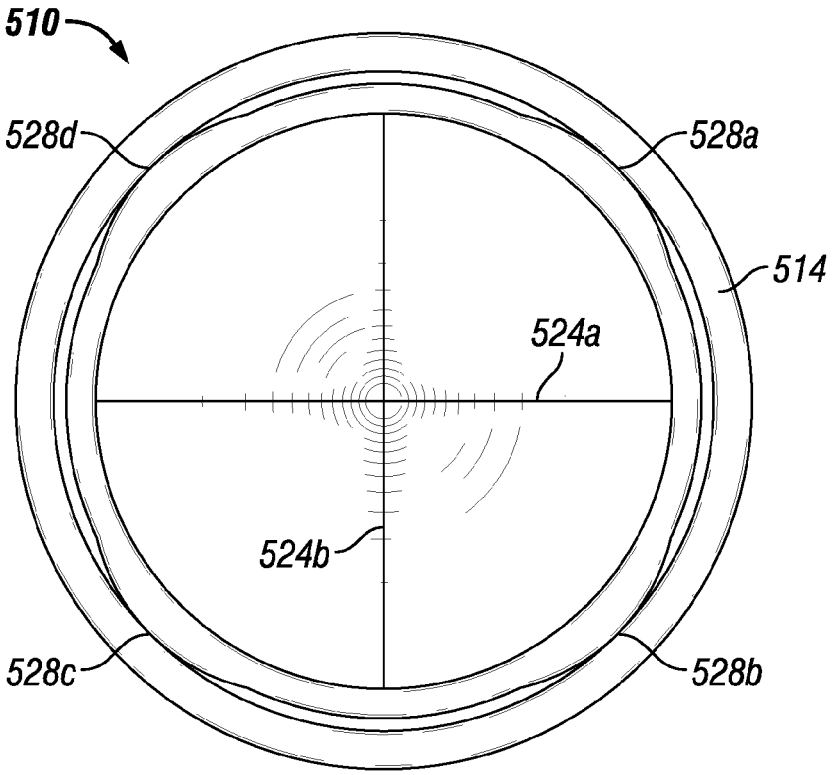
FIG. 5B is an upper plan view of the integrated closure/valve of FIG. 5A.
Figure 6:
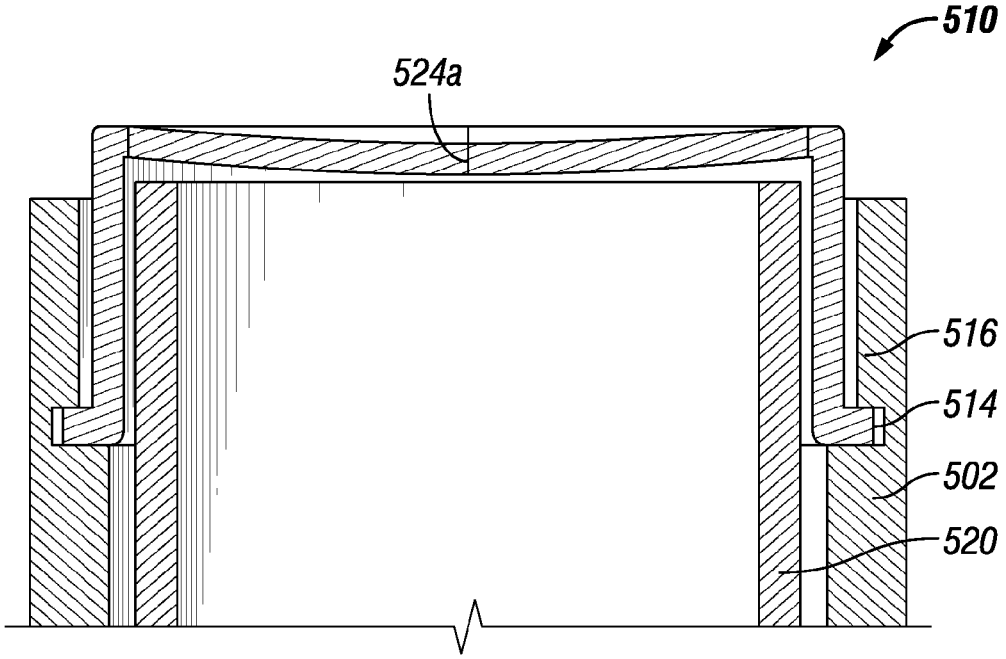
FIG. 6 is a cross-sectional view of a container with the integrated closure/valve of FIG. 5A , in accordance with one embodiment of the present disclosure.

In certain embodiments, as shown in FIGS. 1A-1E, the valve 110 includes a plurality of (i.e., two or more) adjacent sections 112*a*, 112*b*, 112*c*, 112*d* that are configured to contact one another to seal the container 100 when the valve 110 is in a closed position. For example, the valve and its sections may be formed of a suitable material and sized and shaped such that the valve displays internal forces for retaining the valve in the closed position when the container is not in use. Therefore, a predetermined force may be used to open the valve and break the seal that is normally present. In certain embodiments as shown in FIGS. 5A and 5B, the individual sections 512*a*, 512*b*, 512*c*, 512*d* of the valve 510 are circular sectors. That is, the individual sections together form a circular sealed closure. As shown in FIGS. 5A-5B and 6, the individual sections 512*a*, 512*b*, 512*c*, 512*d* of the valve 510 may be formed by slits 524*a*, 524*b*. For example, the individual sections may be semi-circular or pie-shaped.

Figure 3A:
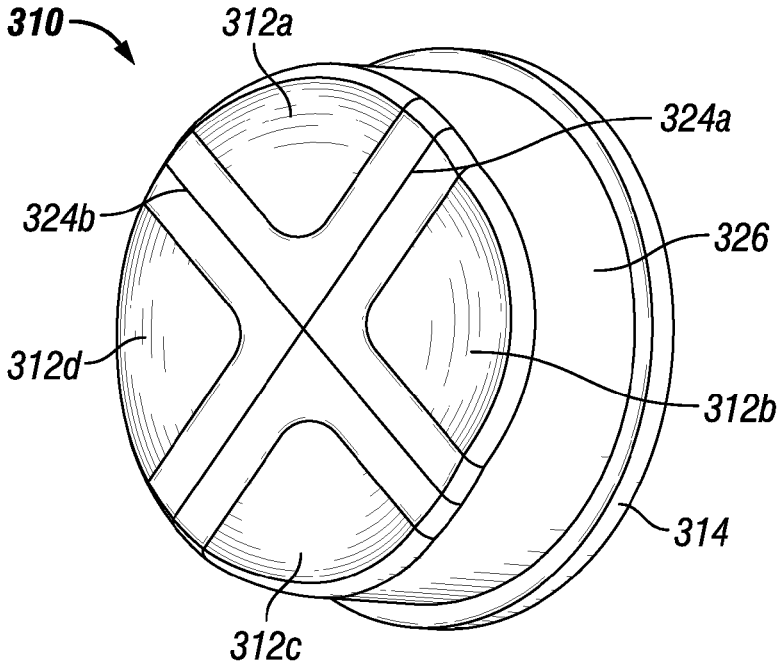
FIG. 3A is a perspective view of an integrated closure/valve, in accordance with one embodiment of the present disclosure.
Figure 3B:
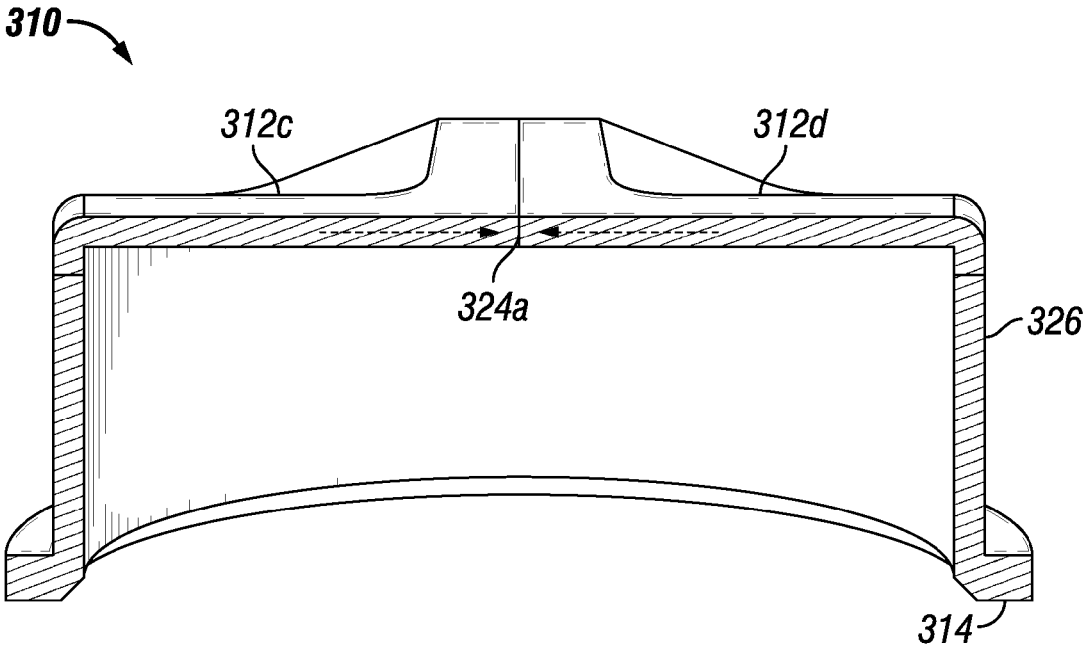
FIG. 3B is a cross-sectional perspective view of the integrated closure/valve of FIG. 3A.
Figure 4:
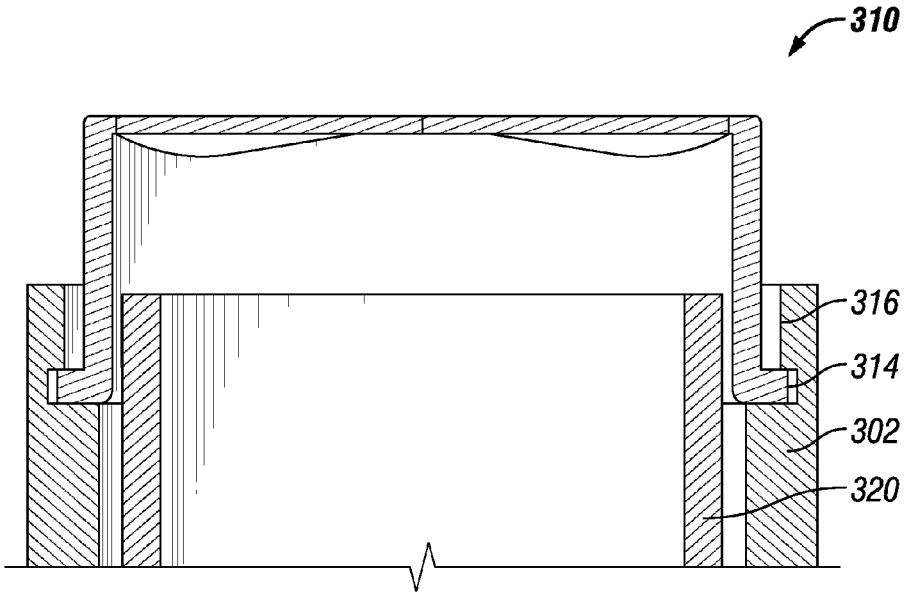
FIG. 4 is a cross-sectional view of a container with the integrated closure/valve of FIG. 3A , in accordance with one embodiment of the present disclosure.

Various designs and configurations of the valve and its sections are envisioned, as is illustrated throughout the Figures. In certain embodiments, as shown in FIGS. 3A and 3B, the closure (i.e., valve) 310 includes a sidewall 326 that extends between a base 314 of the valve 310 and a face of the valve, with the face having the individual sections 312*a*, 312*b*, 312*c*, 312*d* formed therein. The sidewall may have any suitable cross-sectional shape, such as circular, oval, elliptical, rectangular, or other suitable shapes. As shown in FIG. 4, the base 314 of the valve 310 may define an opening through which the valve lifter component 320 and the product (e.g., glue stick) are advanced.

For example, FIGS. 3A and 3B illustrate a valve 310 having a substantially circular face apportioned into four sections 312*a*, 312*b*, 312*c*, 312*d* by slits 324*a*, 324*b*. The sections may be shaped such that each section includes a concavity or partial concavity or another feature designed to encourage the self-sealing property of the valve. For example, as shown in FIGS. 3A and 3B, each section 312*a*, 312*b*, 312*c*, 312*d* may include a concavity extending between the slits 324*a*, 324*b* defining the sections 312*a*, 312*b*, 312*c*, 312*d*. The arrows shown on sections 312*c*, 312*d* in FIG. 3B illustrate the internal forces present in the self-sealing valve. For example, as shown in FIGS. 5A and 5B, each section 512*a*, 512*b*, 512*c*, 512*d* may be curved toward the base 514 of the valve 510, such that together the sections 512*a*, 512*b*, 512*c*, 512*d* form a concave face of the valve 510. For example, each section of the valve 510 may include a radial protrusion 528*a*, 528*b*, 528*c*, 528*d* that is provided along at least a portion of the sidewall 526. As shown in FIG. 6, the base 514 of the valve 510 may define an opening through which the valve lifter component 520 and the product (e.g., glue stick) are advanced.

Figure 1A:
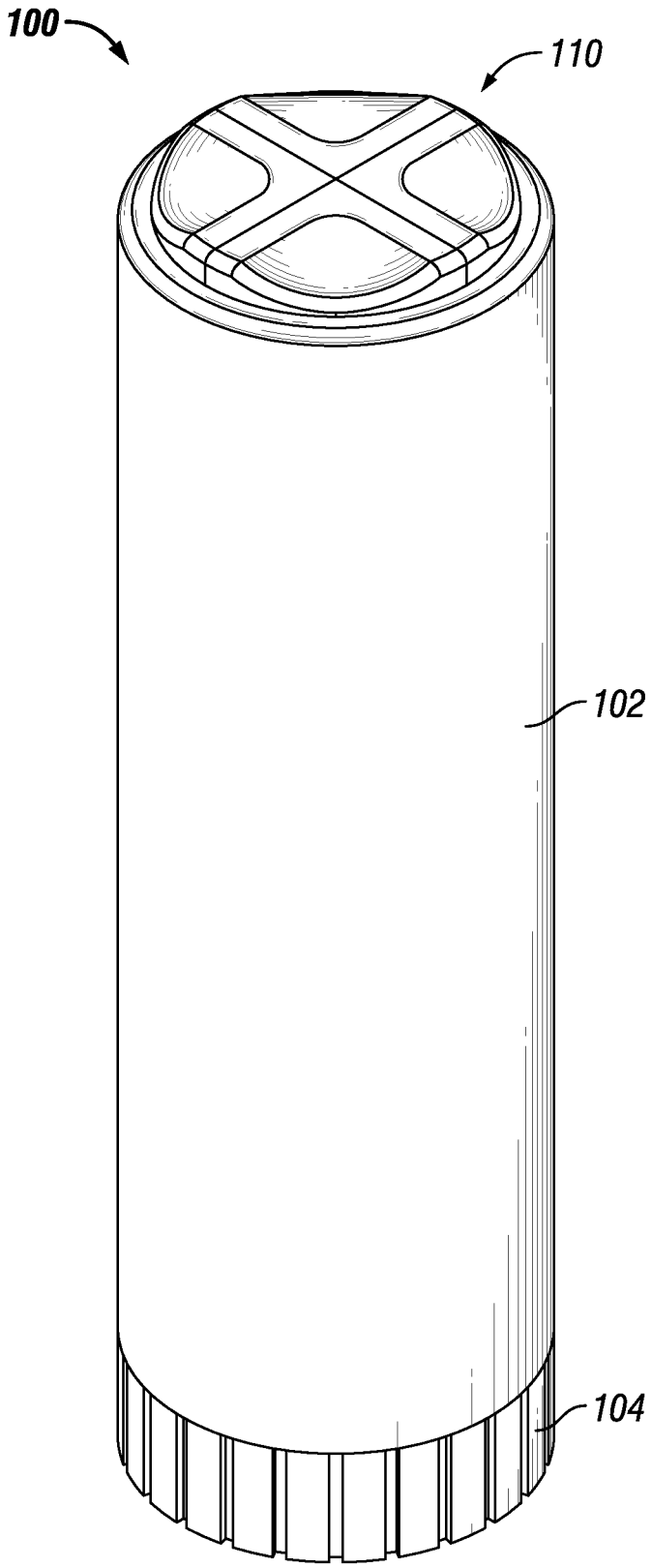
FIG. 1A is an upper perspective view of a container with an integrated closure, in accordance with one embodiment of the present disclosure.
Figure 1B:
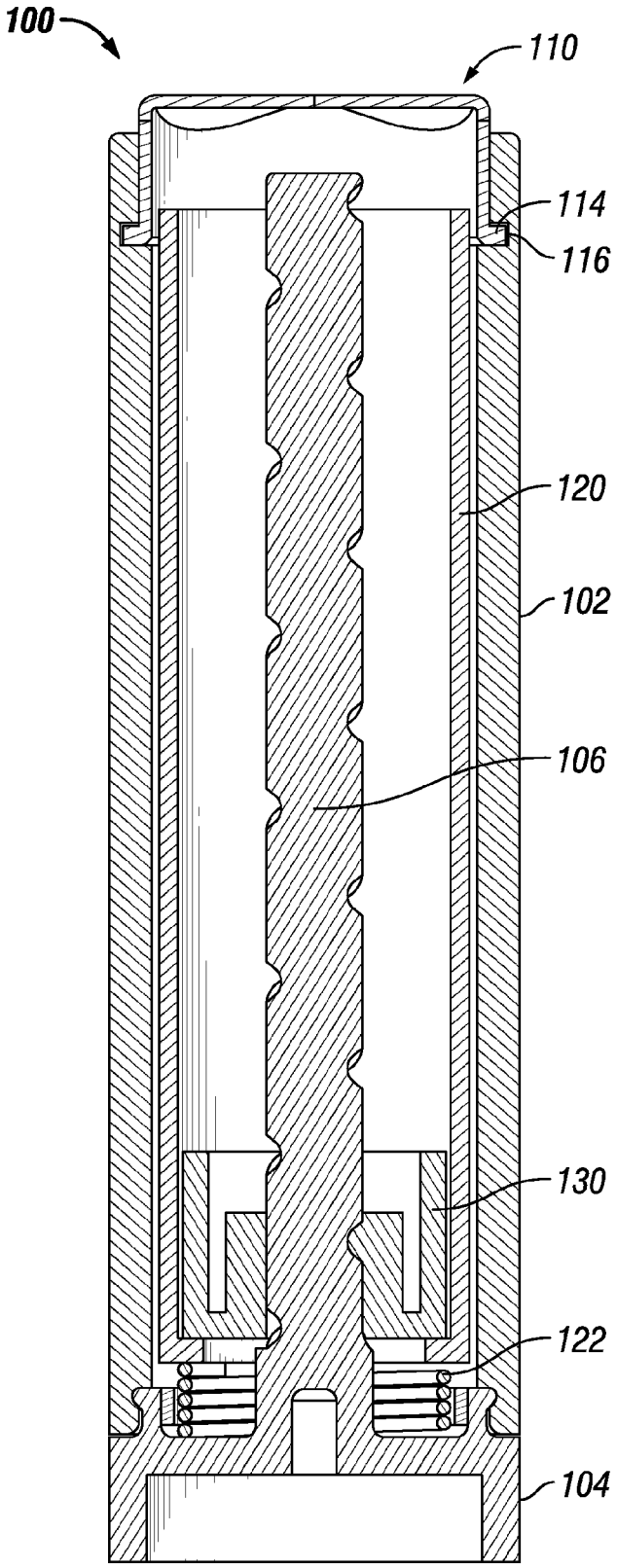
FIG. 1B is a cross-sectional view of the container of FIG. 1A, wherein the valve lifter component is in a retracted position and the valve is in a closed position.
Figure 1C:
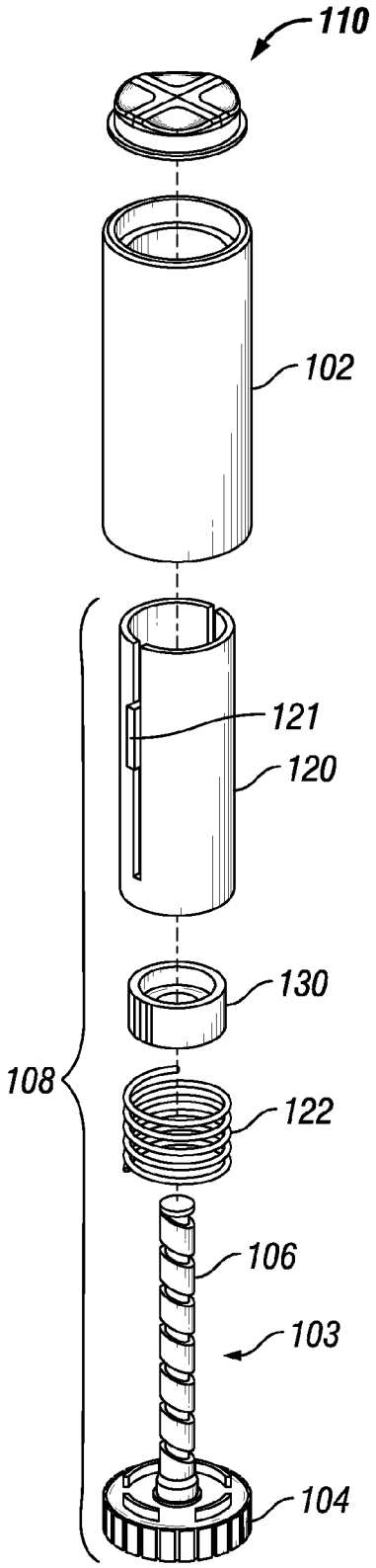
FIG. 1C is an exploded perspective view of the container of FIG. 1A.
Figure 1D:
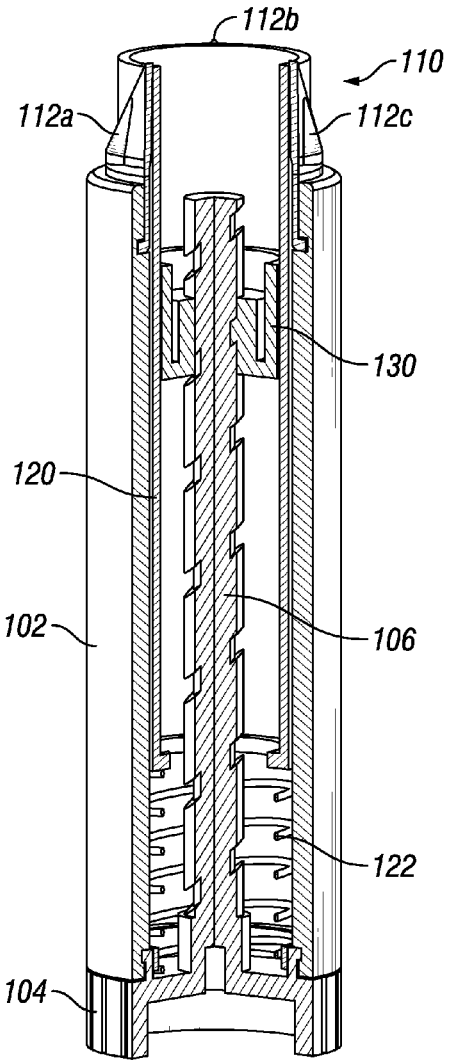
FIG. 1D is a cutaway, perspective view of the container of FIG. 1A, wherein the valve lifter component is in an extended position and the valve is in an open position.
Figure 1E:
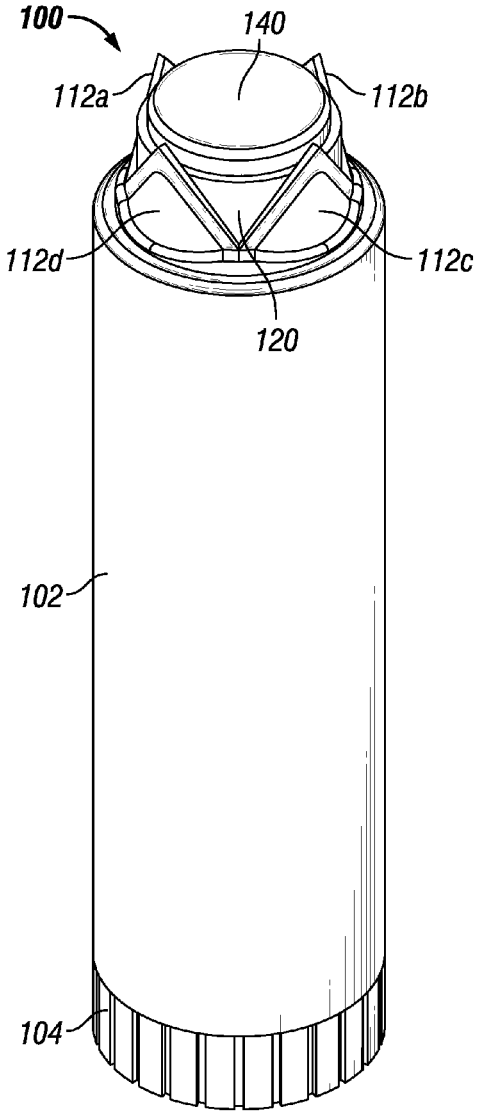
FIG. 1E is an upper perspective view of the container of FIG. 1A, in which a product is protruding through the open valve.

As shown in FIGS. 1D and 1E, when force is applied to the valve 110 from within the housing 102, as will be described in more detail below, the individual sections 112*a*, 112*b*, 112*c*, 112*d* are forced away from one another to create an opening through which a glue product 140 or other material may pass without significantly contacting the valve 110. As shown in FIGS. 1A and 1B, when that force is removed from valve 110, the individual sections 112*a*, 112*b*,

112*c,* 112*d* spontaneously return to the closed position due to the internal forces present in the valve 110.

Figure 7A:
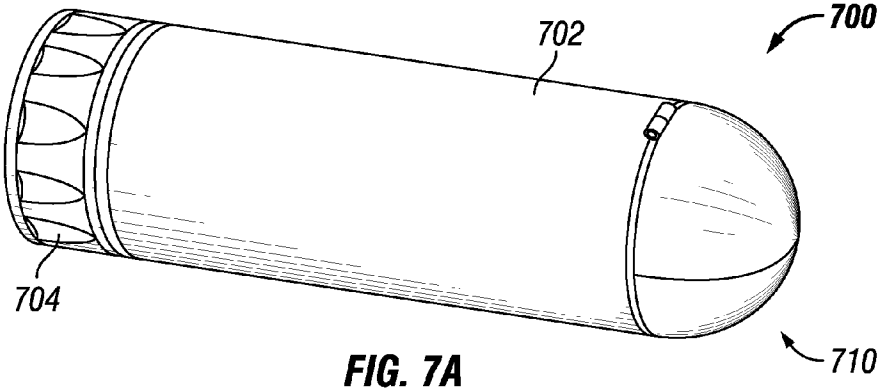
FIG. 7A is a perspective view of a container with an integrated closure, wherein the valve lifter component is in a retracted position and the valve is in a closed position, in accordance with one embodiment of the present disclosure.
Figure 7B:
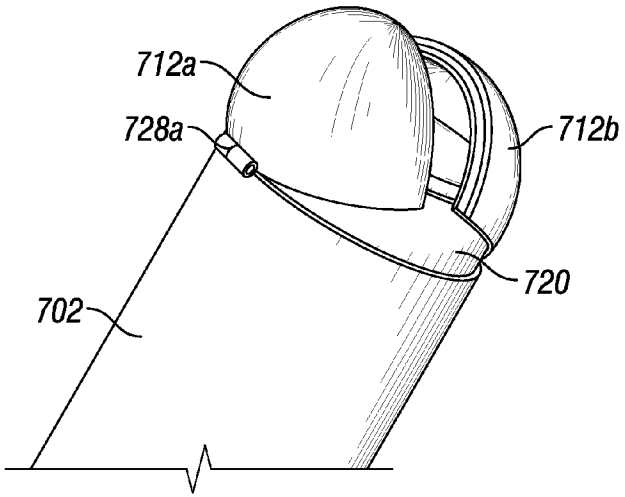
FIG. 7B is a perspective view of the container of FIG. 7A, wherein the valve lifter component is sliding from the retracted position into the extended position, and beginning to open the valve.
Figure 7C:
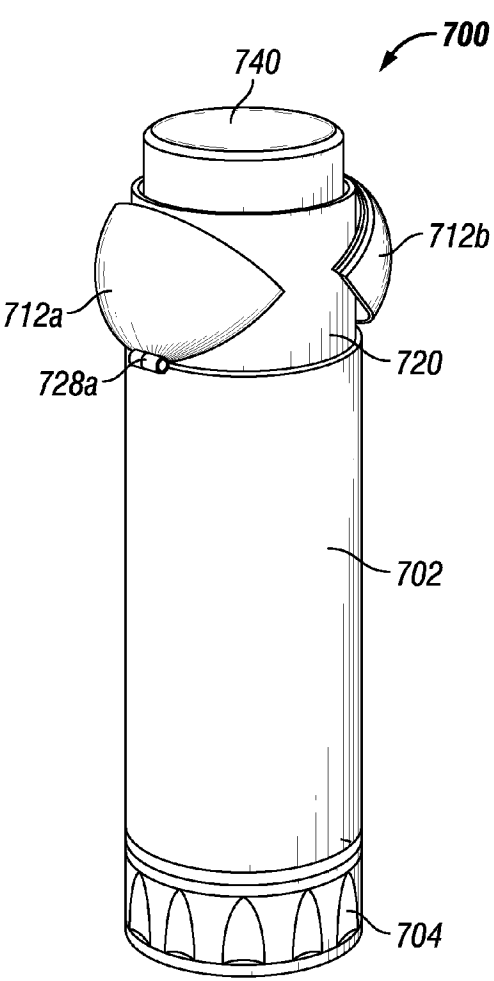
FIG. 7C is a perspective view of the container of FIG. 7A, wherein the valve lifter component is in an extended position and the valve is in an open position, and in which a product is protruding through the open valve.

In other embodiments, as shown in FIGS. 7A-7C and 8A-8C, the valve is configured to mechanically spontaneously close upon removal of a force from the valve. In such embodiments the valve may or may not include a material that is self-sealing. For example, as shown in FIGS. 7A-7C, the valve 710 of container 700 may include two semi-spherical sections 712*a,* 712*b* that are hingedly connected to the housing 702. Upon application of a suitable force from within the housing 702 to the hinges 728*a* and/or valve 710, the valve 710 is opened to allow the product 740 to protrude from the housing 702. Upon removal of the force, the valve 710 may be designed such that it spontaneously returns to the closed position, such as via a spring-loaded hinge or other suitable attachment mechanism that bias the valve 710 in the closed position. The force may be applied and removed from the valve 710 through the use of a mechanical device including a valve lifter component 720 as is described below, which is actuated by the user rotating base portion 704 of the screw component.

Figure 8C:
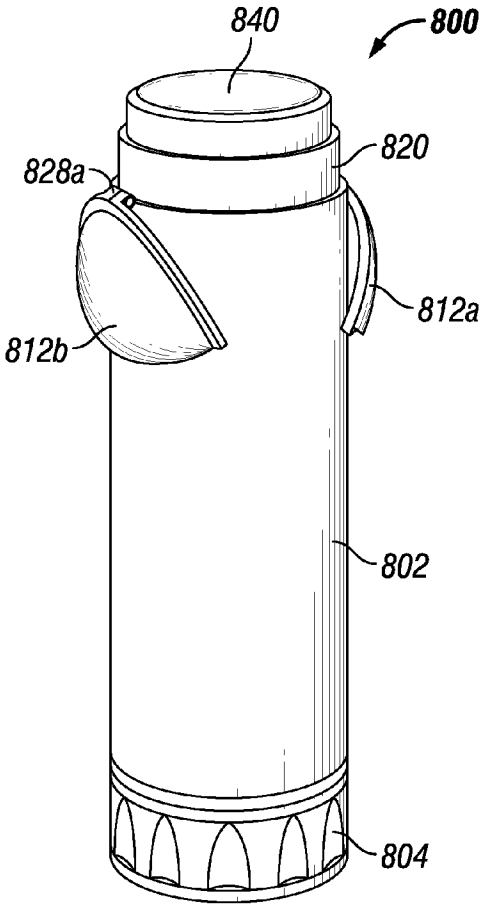
FIG. 8C is a perspective view of the container of FIG. 8A, wherein the valve lifter component is in an extended position and the valve is in an open position, and in which a product is protruding through the open valve.
Figure 8A:
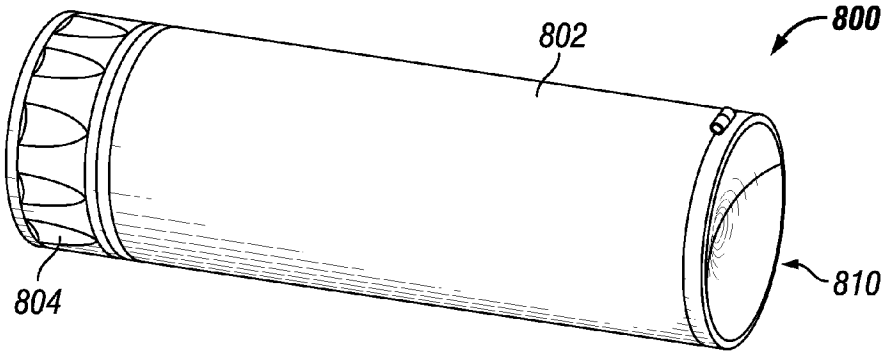
FIG. 8A is a perspective view of a container with an integrated closure, wherein the valve lifter component is in a retracted position and the valve is in a closed position, in accordance with one embodiment of the present disclosure.
Figure 8B:
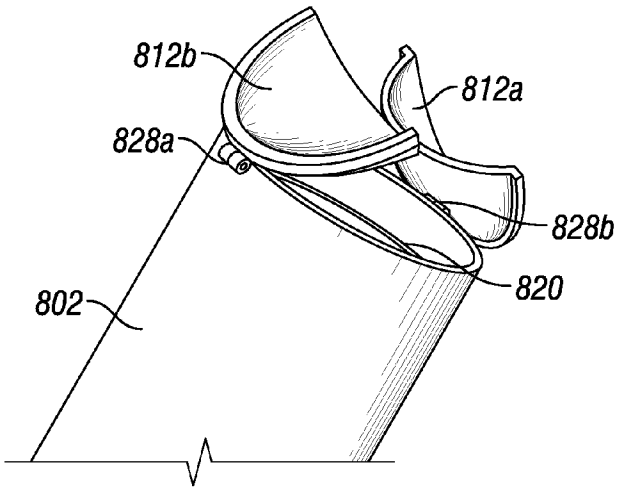
FIG. 8B is a perspective view of the container of FIG. 8A, wherein the valve lifter component is sliding from the retracted position into the extended position, and beginning to open the valve.

For example, as shown in FIGS. 8A-8C, the valve 810 of container 800 may include two curved sections 812*a,* 812*b* that together form a concave valve 810, when closed. The sections 812*a,* 812*b* may be hingedly attached to the housing 802, via hinges 828*a,* 828*b,* such that upon application of a suitable force from within the housing 802, to the hinges 828*a,* 828*b* or to a mechanism in operable communication therewith, the valve 810 is opened to allow the product 840 to protrude from the housing 802. The force may be applied and removed from the valve 810 through the use of a mechanical device including a valve lifter component 820 as is described below, which is actuated by the user rotating base portion 804 of the screw component.

In certain embodiments, as shown in FIGS. 1B and 1D, the valve 110 is mounted within the housing 102. For example, the valve may include one or more projections on its sidewall or base 114 that are designed to mate with one or more corresponding grooves or notches 116 in the housing 102. In certain embodiments, the valve is configured to be snap-fit within the housing. FIG. 4 shows one embodiment of a valve 310 that is configured to be snap-fit within the housing 302, via a radial annular projection at the base 314 of the valve 310 that snap-fits into a correspondingly sized and shaped groove 316 of the housing 302. FIG. 6 shows another embodiment of a valve 510 having a different design that is configured to be snap-fit within the housing 502, via a radial projection at the base 514 of the housing 502 that snap-fits into a correspondingly sized and shaped groove 516 of the housing 502. In other embodiments, a retaining ring or pin(s) may be used to secure the base of the valve within the housing.

Figure 2:
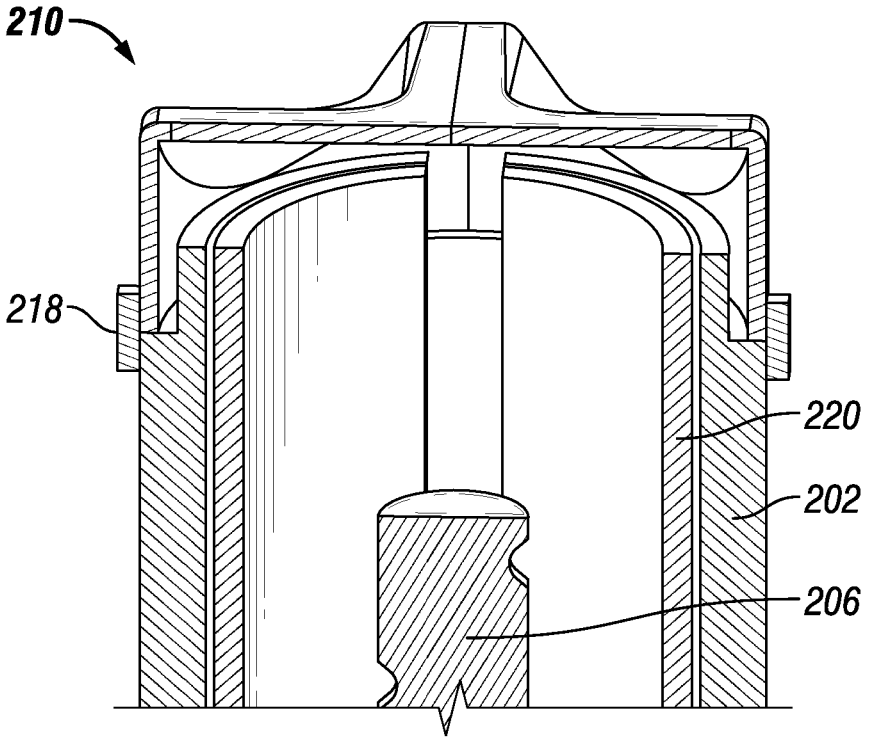
FIG. 2 is a cross-sectional perspective view of a container with an integrated closure, in accordance with one embodiment of the present disclosure.

In other embodiments, as shown in FIG. 2, the valve 210 is mounted over the exterior of the housing 202. For example, the valve may be configured to snap fit about the external surface of the housing or may be configured to be secured about the external surface of the housing by the elastic nature of the material forming the base and sidewall of the valve, or by a suitable retaining ring or pin(s). For example, as shown in FIG. 2, a retaining ring 218 may be used to secure the valve 210 about the external surface of the housing 202. In such embodiment, the retaining ring 218 and valve 210 are designed to withstand the forces associated with valve lifter component 220 applying a force to the valve 210 to open the valve 210, such that the product (e.g., glue stick) may be advanced via the mechanical device described below (e.g., via the elevator advancing along threaded portion 206 of the screw component) for use. For example, the material from which the valve is made may be stretched over the exterior housing and secured by the elastic nature of the material.

Containers of the present disclosure also include a mechanical device for advancing a product through the container and for opening the valve. As shown in FIGS. 1A-1E, in certain embodiments, the mechanical device 108 includes a screw component 103, a valve lifter component 120, an elevator component 130, and a biasing element 122. The mechanical device may be a partially internal mechanism configured for both (i) elevating/advancing a glue stick or other product from the interior of the housing to the exterior of the housing through one end thereof, and (ii) opening the valve to allow the glue stick or other product to protrude from the housing so that it may be used for its intended purpose. When operated in reverse, the mechanical device retracts the glue stick or other product back into the housing and closes the valve, thereby sealing the container once the product has been retracted.

The screw component 103 includes a base portion 104 that is positioned outside of the exterior housing 102 at a second end opposite the valve 110 and a threaded portion 106 extending from the base portion 104 within the exterior housing 106. The base portion 104 of the screw component 103 is configured to be rotated by a user to effect advancement or retraction of the product through the housing 102. The threaded portion 106 of the screw component 103 is associated with the base portion 104 such that rotation of the base portion 104 results in a corresponding rotation of the threaded portion 106.

Elevator component 130 is positioned within the exterior housing 102 and is configured to advance the product through the container 100. For example, the elevator component may include a platform or other suitable surface to engage a surface of the product and apply a suitable force thereto. In certain embodiments, the elevator component 130 is engaged and operated by the threaded portion 106 of the screw component 103. That is, upon rotation of the threaded component 106, the elevator is advanced or retracted (depending on the direction of rotation) through the housing 102, via the threads of the threaded portion 106. As the elevator component 130 advances through the housing 102, the glue product 140 or other material is pushed through the container 100.

A valve lifter component 120 is operable to open the valve 110 and is positioned at least partially within the exterior housing 102. The valve lifter component 120 is selectively slidable between a retracted position, in which the valve 110 is closed (see FIG. 1B), and alternatively an extended position, in which the valve 110 is open (see FIG. 1D). Thus, when the valve lifter component 120 is in the retracted position, as shown in FIG. 1B, it is disposed wholly within the housing 102. When the valve lifter component 120 is in the extended positioned, as shown in FIG. 1D, it is disposed partially within the housing 102.

In certain embodiments, the valve lifter component 120 is operable to open the valve 110 by contacting the valve 110 or a mechanism associated therewith (e.g., a hinge or other mechanism in operable connection with the valve) with a second end of the valve lifter component 120 to overcome a sealing force of the valve 110 (e.g., of the plurality of adjacent sections) and thereby create an opening through which the product 140 is advanced. In certain embodiments, the end of the valve lifter component 120 contacts the interior surface of the valve 110 and forces the valve 110 into the open position. In other embodiments, the valve lifter component may engage a hinge, rib, or other mechanism that in turn forces the valve into the open position.

For example, the valve lifter component 120 may be a sleeve (e.g., tubular in shape), rod, or other suitable mechanism configured to interact with both the biasing element 122 and the valve 110. In certain embodiments, the valve lifter component 120 is substantially tubular and the elevator component 130 is disposed within the tubular valve lifter component 120. In certain embodiments, the elevator has an annular sidewall that is dimensioned to fit within the tubular valve lifter component, such that the elevator is able to advance and retract therein.

In some embodiments, as shown in FIG. 1C, the valve lifter component 120 has at least one rib 121 or other suitable projection on an external surface of the valve lifter component 120. The at least one rib 121 may be sized and shaped to fit within a corresponding track (not visible) on an inner surface of the exterior housing 102. For example, the valve lifter component 120 may be selectively slidable between the retracted position, wherein the at least one rib 121 is positioned at a first end of the track, and alternatively the extended position, wherein the at least one rib 121 is positioned at a second end of the track, opposite the first end. Thus, the track of the housing 102 may limit the advancement of the valve lifter component 121, such that it is only able to move between the retracted position and the extended position. In certain embodiments, this movement between the retracted and extended positions may cover an axial distance of from about 0.5 cm to about 3 cm.

A biasing element 122 is positioned at a first end of the valve lifter component 120 and engages and applies a force to the valve lifter component 120. In some embodiments, the biasing element is a spring or other suitable biasing mechanism. In certain embodiments, the spring and the valve lifter component have similar outer diameters, such that the spring engages the end of the valve lifter component. In some embodiments, as shown in FIG. 1D, the valve lifter 120 includes a projection(s) that extends radially inward to provide an extended surface for engaging the spring 122. In certain embodiments, the spring is an open coil helical compression spring.

In certain embodiments, the biasing element 122 that engages and advances the valve lifter component 120 is positioned at the base of the valve lifter component 120 near the base portion 104 of the screw component 103. With regard to the operation of one embodiment, as shown in FIG. 1B, when the glue stick container 100 is initially removed from its packaging, the elevator component 130 will be positioned in a completely retracted position, nested within the valve lifter 120 at the same end of the valve lifter 120 at which the biasing element 122 is engaged.

The elevator component 130 in its retracted position is configured to exert a force (i.e., provide a load) on the valve lifter 120 and biasing element 122, such that the biasing element (e.g., spring) 122 is compressed, as shown in FIG. 1B. Likewise, as the elevator component 130 is advanced, via rotation of the threaded portion 106 of the screw component 103, the pressure on spring 122 is relieved (i.e., the load from the elevator component is decreased or removed) and the spring 122 is able to expand toward its unloaded state. As the spring 122 expands, it applies a force to the valve lifter component 120 that is sufficient to advance the valve lifter component 120 into its extended position, as shown in FIG. 1D. In certain embodiments, the valve lifter component 120 may be disposed within the housing 102 so as to be slidable within the housing in a manner that is substantially unimpeded, other than by a track or similar feature configured to limit the axial distance traveled by lifter component 120. That is, the valve lifter component 120 may not be rigidly connected to the housing 102 or the other components of the container 100, other than the at the rib 121/track interface.

Once the load from the elevator component 130 is removed, the spring 122 then pushes the valve lifter component 120 ahead of the glue product 140, opening the valve 110 so that the glue product 140 can pass through the opening without contacting the valve 110. In certain embodiments, the travel of the valve lifter component 120 stops when ribs 121 included on its outer diameter contact the end of the track or groove in which the ribs slide, wherein the groove is formed on the inner diameter of the housing 102. In other embodiments, the biasing element and valve lifter component may be designed such that the force exerted on the valve lifter component by the biasing element to advance the valve lifter component is suitable for advancing the valve lifter component a desired distance to open the valve, but does not result in the valve lifter component being advanced past the housing or past a desired distance.

Upon retraction, which is accomplished by reversing the rotation of the screw component (i.e., by reversing rotation of the base portion, which in turn reverses rotation of the threaded portion), the elevator component returns to its original position and retracts the valve lifter component to allow the valve action of the closure to effectively seal the container.

Methods for dispensing a product from a container are also provided, and include providing a container having any combination of features described herein, such as an exterior housing, a valve disposed at a first end of the exterior housing, and a mechanical device for advancing the product through the container and for opening the valve. With reference to FIGS. 1A-1E, in certain embodiments the methods further include rotating a base portion 104 of the screw component 103 that is positioned outside of the exterior housing 102 an end opposite the valve 110, to correspondingly rotate a threaded portion 106 of the screw component 103 within the exterior housing 103 and thereby advance the elevator component 130, to advance the product 140 through the container 100. In certain embodiments, advancing the elevator component 130 decreases the load on the biasing element 122, such that the biasing element 122 applies a force effective to selectively slide the valve lifter component 120 into an extended position in which the valve lifter component 120 opens the valve 110.

For example, the valve lifter component 120 may open the valve 110 by contacting the valve 110 or a mechanism associated therewith (e.g., a hinge or other mechanism in operable communication with the valve) with an end of the valve lifter component 120 to overcome a sealing force of the valve 110 and thereby create an opening through which the product 140 is advanced. In certain embodiments, the end of the valve lifter component 120 contacts the interior surface of the valve 110 and forces the valve 110 into the open position. In other embodiments, the valve lifter component may engage a hinge, rib, or other mechanism that in turn forces the valve into the open position. As described herein, in certain embodiments, the valve is self-sealing upon removal of the end of the valve lifter component therefrom.

Thus, the present disclosure advantageously provides a container for use with glue sticks or other materials that provides both an effective means for dispensing the product and a properly sealing closure that cannot be easily broken or lost.

While the disclosure has been described with reference to a number of embodiments, it will be understood by those skilled in the art that the invention is not limited to such disclosed embodiments. Rather, the invention can be modified to incorporate any number of variations, alterations, substitutions, or equivalent arrangements not described herein, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed:

1. A container, comprising:

an exterior housing;

a valve disposed at a first end of the exterior housing, wherein the valve comprises a plurality of adjacent sections that are configured to contact one another to seal the container when the valve is in a closed position; and a mechanical device for advancing a product through the container and for opening the valve, wherein the mechanical device comprises:

a screw component having a base portion positioned outside of the exterior housing at a second end opposite the valve and a threaded portion extending from the base portion within the exterior housing;

a valve lifter component operable to open the valve and positioned at least partially within the exterior housing, wherein the valve lifter component is selectively slidable between a retracted position, in which the valve is closed, and alternatively an extended position, in which the valve is open;

a biasing element positioned at a first end of the valve lifter component, wherein the biasing element engages and applies force to the valve lifter component; and an elevator component positioned within the exterior housing for advancing the product through the container, wherein the elevator component is engaged and operated by the threaded portion of the screw component.

2. The container of claim 1, wherein the product is a glue stick.

3. The container of claim 1, wherein the exterior housing is substantially cylindrical.

4. The container of claim 1, wherein the valve lifter component is operable to open the valve by contacting the valve with a second end of the valve lifter component to overcome a sealing force of the plurality of adjacent sections of the valve and thereby create an opening through which the product is advanced.

5. The container of claim 4, wherein the valve is self-sealing upon removal of the second end of the valve lifter component therefrom.

6. The container of claim 1, wherein the valve comprises an elastomer.

7. The container of claim 1, wherein the sections of the valve each comprise a circular sector.

8. The container of claim 1, wherein the valve lifter component is tubular and the elevator component is disposed within the tubular valve lifter component.

9. The container of claim 1, wherein:

the valve lifter component comprises at least one rib on an external surface of the valve lifter component, and the exterior housing comprises at least one track for receiving the at least one rib of the valve lifter component, such that the valve lifter component is selectively slidable between the retracted position, wherein the at least one rib is positioned at a first end of the track, and alternatively the extended position, wherein the at least one rib is positioned at a second end of the track, opposite the first end.

10. The container of claim 1, wherein the valve is mounted within the exterior housing.

11. The container of claim 1, wherein the valve is mounted over the exterior housing.

12. The container of claim 1, wherein the biasing element is an open coil helical compression spring.

13. A method for dispensing a product from a container, comprising:

providing a container that comprises:

an exterior housing;

a valve disposed at a first end of the exterior housing; and a mechanical device for advancing the product through the container and for opening the valve, the mechanical device comprising a screw component, a valve lifter component, an elevator component, and a biasing element; and rotating a base portion of the screw component that is positioned outside of the exterior housing at a second end opposite the valve, to correspondingly rotate a threaded portion of the screw component within the exterior housing and thereby advance the elevator component, to advance the product through the container, wherein advancing the elevator component decreases a load on the biasing element, such that the biasing element applies a force effective to selectively slide the valve lifter component into an extended position in which the valve lifter component opens the valve.

14. The method of claim 13, wherein the valve lifter component opens the valve by contacting the valve with an end of the valve lifter component to overcome a sealing force of the valve and thereby create an opening through which the product is advanced.

15. The method of claim 14, wherein the valve is self-sealing upon removal of the end of the valve lifter component therefrom.

16. The method of claim 13, wherein the valve comprises a plurality of adjacent sections that are configured to contact one another to seal the container when the valve is in a closed position.

17. The method of claim 13, wherein the sections of the valve each comprise a circular sector.

18. The method of claim 13, wherein the valve comprises an elastomer.

19. The method of claim 13, wherein the valve lifter component is tubular and the elevator component is disposed within the tubular valve lifter component.

20. The method of claim 13, wherein:

the valve lifter component comprises at least one rib on an external surface of the valve lifter component, and the exterior housing comprises at least one track for receiving the at least one rib of the valve lifter component, such that the valve lifter component selectively slides between a retracted position in which the valve is closed, wherein the at least one rib is positioned at a first end of the track, and alternatively the extended position, wherein the at least one rib is positioned at a second end of the track, opposite the first end.

* * * * *